US005256930A

United States Patent [19]

Hughes

[11] Patent Number: 5,256,930

[45] Date of Patent: Oct. 26, 1993

[54] COOLED PLASMA SOURCE

[75] Inventor: William E. Hughes, Annandale, Va.

[73] Assignee: Commonwealth Scientific Corporation, Alexandria, Va.

[21] Appl. No.: 833,049

[22] Filed: Feb. 10, 1992

[51] Int. Cl.[5] ..... H05H 1/28; H05H 1/54; H01J 7/24

[52] U.S. Cl. ..... 313/30; 313/32; 313/33; 313/231.41; 313/360.1; 313/362.1

[58] Field of Search ..... 313/33, 360.1, 231.41, 313/30, 32

[56] References Cited

U.S. PATENT DOCUMENTS 3,408,283 10/1968 Chopra et al. .

4,272,699 6/1981 Faubel et al. ..... 313/360.1

OTHER PUBLICATIONS

"*Broad-Beam Ion Sources,*" Review of Scientific Instruments vol. 61, pp. 230–235, Jan. 1990.

*Characteristics, Capabilities and Applications of Broad--Beam Ion Sources,* Commonwealth Scientific Corporation, Alexandria, BA, pp. 9–10 (1987).

"*High Performance, Low Energy Ion Source,*" IEE Transactions on Plasma Science, vol. PS-6, No. 4, pp. 535–538, Dec. 1978.

*Primary Examiner*—Palmer C. DeMeo

*Attorney, Agent, or Firm*—Hugh H. Drake

[57] ABSTRACT

A cooled plasma source for producing ions by electrical discharge. A cooled plate is positioned in the chamber of the plasma source for blocking thermal radiation from an electron-emitting cathode. The presence of the cooled plate results in significantly decreased substrate temperatures, as compared to use of conventional plasma source apparatus. As a result, the cooled plasma source may be used for treatment of heat-sensitive plastic substrates.

16 Claims, 3 Drawing Sheets

COOLED PLASMA SOURCE

This invention relates to plasma and ion sources. More particularly, it pertains to plasma and ion sources with reduced heat output and hence reduced heating of substrates being processed.

Broad-beam ion sources, in which grids with a plurality of apertures serve to electrostatically accelerate ions, have been used for many years both for electric space propulsion and for industrial applications. A review of the history and technology of these sources was presented by H. R. Kaufman in "Broad-Beam Ion Sources," *Review of Scientific Instruments,* Vol. 61, pp. 230–235, January, 1990.

A recurrent problem in the industrial applications of broad-beam sources is the heating of the work pieces in the ion beam, usually called substrates. Because the ion beam is generated in a vacuum, it is difficult to cool the substrates. Some of the methods used to cool substrates are described in a publication by H. R. Kaufman, R. S. Robinson, and W. E. Hughes, *Characteristics, Capabilities, and Applications of Broad-Beam Ion Sources,* Commonwealth Scientific Corporation, Alexandria, Va., pp. 9–10 (1987).

The heating of a substrate results from both energetic ion collisions with the substrate and radiation from hot components of the ion source. The heating due to ion collisions with the substrate is generally necessary in ion-source applications, in that some minimum ion energy, and therefore heating, is required to carry out the process.

The heating from hot ion-source components can be less necessary in that some components may be cooled without affecting the operation of the ion source. An example of such cooling was described for a single-aperture ion source (not a broad-beam ion source) in U.S. Pat. No. 3,408,283 (K. L. Chopra et al., "High Current Duoplasmatron Having an Apertured Anode Positioned in the Low Pressure Region"), in which the wall of the discharge chamber, and the cathode supports, were water cooled. Similar cooling for a broad beam ion source was described by J. T. Crow, A. T. Forrester, and D. M. Goebel, "High Performance, Low Energy Ion Source," *IEEE Transactions on Plasma Science,* Vol. PS-6, No. 4, pp. 535–538, December, 1978, in which the wall of the discharge chamber is water cooled.

It should be noted that there is a hot, electron-emitting cathode in both of the above-described cooling examples. The cathode itself cannot be cooled without losing the thermionic emission upon which the cathode operation depends. The effect of the cooled cathode supports in Chopra, et al. extends only a short distance from the supports along the filament; consequently, it does not constitute a significant cooling of the cathode.

There has not heretofore been provided an effective and reliable system for cooling a plasma or ion source to reduce undesirable heating of a target substrate. To that end, the plasma source includes a chamber having an open end and within which chamber ions are produced by means of electrical discharge and then propelled outwardly toward a target substrate. As an improvement, a cooled plate is positioned within the chamber.

The features of the present invention, together with further objects and advantages thereof, are described and illustrated herein with reference to the following description and the accompanying drawings, wherein like reference characters refer to the same elements throughout the several views and in which.

Figure 1:
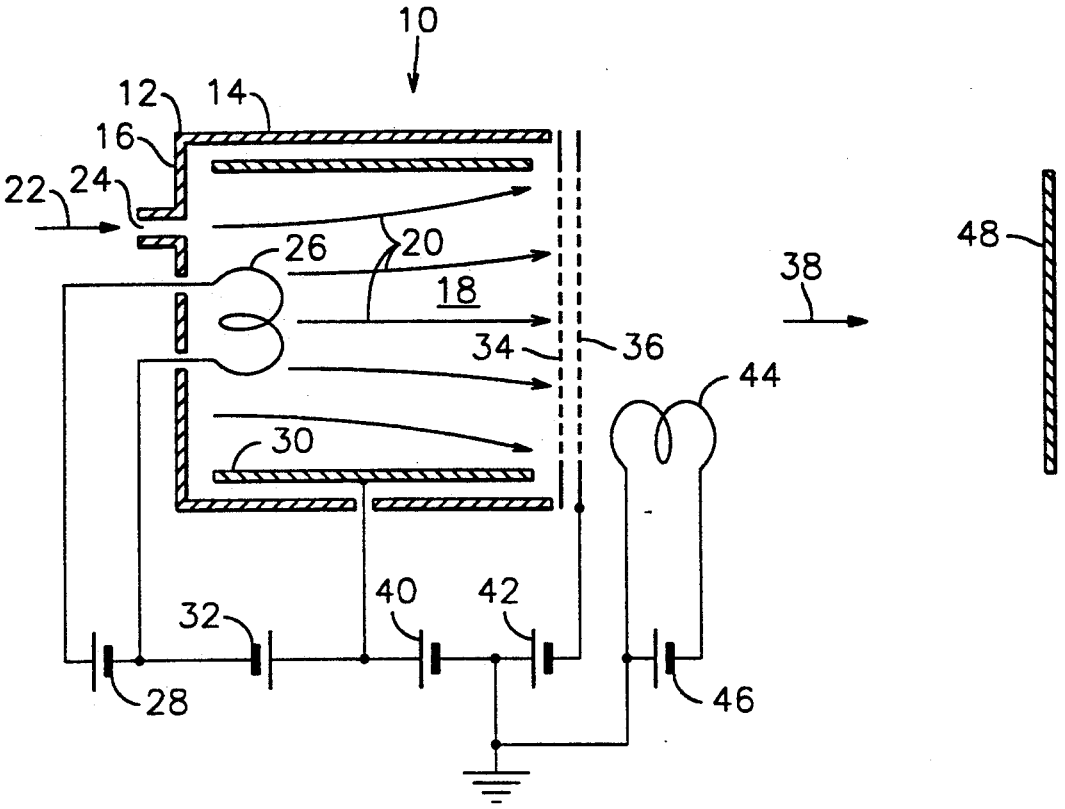
PRIOR ART Fig. 1
FIG. 1 is a partially schematic cross-sectional view of a prior art ion source and its power supplies.

Referring to FIG. 1, a conventional ion source 10 is illustrated. An outer wall 12 of the ion source housing or chamber includes a cylindrical wall portion 14 which is closed at one end with end wall portion 16. Outer wall 12 encloses a discharge volume 18 within which is a magnetic field 20 generated by conventional permanent-magnet or magnetic-solenoid means (neither means shown). An ionizable gas 22 enters discharge volume 18 through a port 24 in outer wall 12. Discharge electrons (not shown) are emitted by a hot-filament cathode 26, which is heated by a cathode power supply 28. The discharge electrons are attracted to an anode 30 which is biased positive, relative to electron emitting cathode 26, by means of a discharge power supply 32. The pressure in the discharge volume is typically in the $10^{-2}$ Pascal ($10^{-4}$ Torr) range, so that most discharge electrons would pass directly from cathode 26 to anode 30 except that the magnetic field restrains such electrons until they collide with ionizable gas molecules to thereby generate ions.

The ions which reach a screen grid 34 are extracted through a plurality of apertures in the grid by a negatively biased accelerator grid 36, which has a similar plurality of apertures aligned with those of screen grid 34, so that in normal operation the ions continue on to form an ion beam 38. The negative bias for ion extraction is provided by a beam power supply 40 and an accelerator power supply 42. Charge and current neutralizing electrons (not shown) are emitted by a hot-filament neutralizer 44, which is heated by a power supply 46. The negative bias of accelerator power supply 42 on accelerator grid 36 provides a potential barrier which prevents the neutralizing electrons from flowing back into discharge volume 18. Ion beam 38, together with the neutralizing electrons, continues on to strike a substrate 48 and there performs the etching, deposition or property-modification function that is desired. The energy of ion beam 38 is determined by beam power supply 40.

Figure 2:
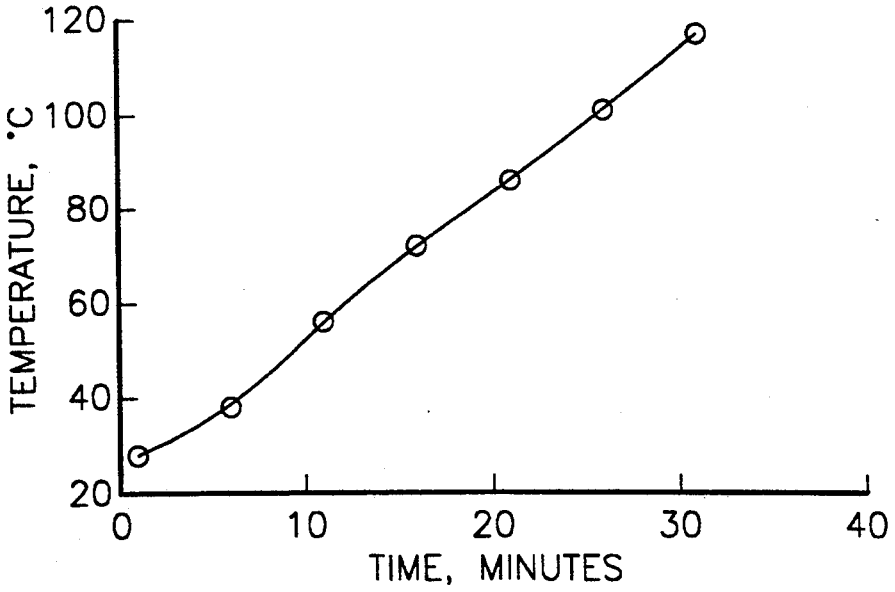
PRIOR ART Fig. 2
FIG. 2 is a graph which shows the variation of substrate temperature with operating time when using the prior art ion source.

Referring to FIG. 2, it will be observed that the substrate temperature increases with ion-source operating time, with the heating of the substrate resulting both from (a) the collisions of energetic ions with the substrate and (b) radiation from hot components of the ion source. One of these hot components is the neutralizer. It is generally desirable to minimize substrate damage by operating with a neutralizer, so that turning off the neutralizer is not a practical way of reducing substrate heating.

Figure 3:
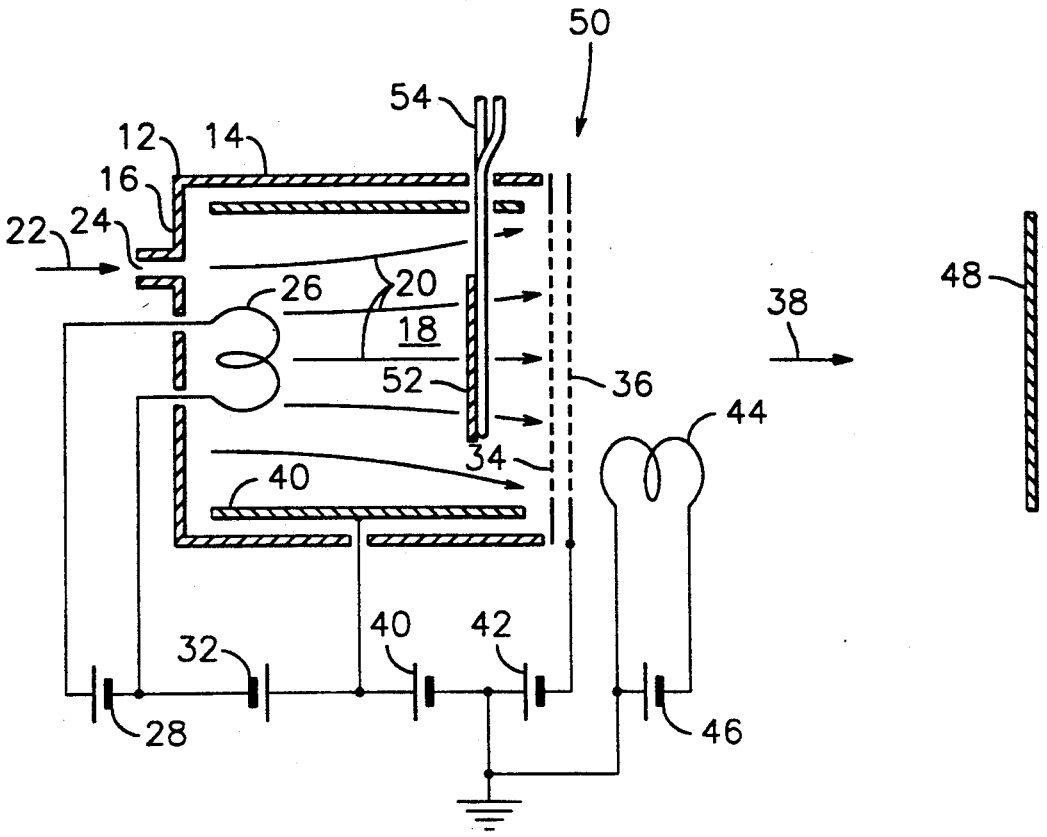
FIG. 3 is a partially schematic cross-sectional view of an ion source constructed according to the present invention.

FIG. 3 illustrates one embodiment of a cooled plasma source 50 of the invention. In this embodiment, the operation is the same as described above in connection with the apparatus of FIG. 1, except for the addition of a cooled plate 52 and a cooling-water flow line 54. To avoid disturbing magnetic field 20, plate 52 and flow line 54 are of a non-magnetic material such as stainless steel which also exhibits a reasonably high heat conductivity,. Plate 52 and flow line 54 are either electrically isolated or maintained at the potential of cathode 16. The cooled plate blocks thermal radiation from electron-emitting cathode 26 and much of the thermal radiation from discharge volume 18.

Figure 4:
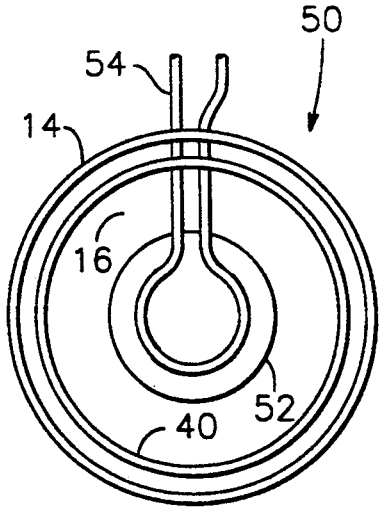
FIG. 4 is a front elevational view of the ion source of FIG. 3 but with certain grids and a neutralizer removed.

FIG. 4 is a front elevational view of the apparatus shown in FIG. 3 with accelerator grid 36 and screen grid 34 removed to show the inside. The presence of cooled plate 52 results in significantly decreased substrate temperatures, as compared to use of the conventional apparatus shown in FIG. 1. This significant improvement is readily seen by comparing FIG. 5 to FIG. 2.

The size and shape of the cooled plate may vary. The most important requirement is to prevent radiation from the hot cathode (or cathodes) from reaching the substrate. At the same time, the presence of the cooled plate in the discharge volume increases the loss of ions. This loss of ions results in a drop in ion beam current, unless the discharge current between the cathode and anode is increased to offset this loss.

One method of optimizing the cooling effect is to reduce the size of the cooled plate to the minimum necessary to block radiation from the cathode, and thereby minimize the loss of ions. If there are several hot cathodes in the ion source, the cooled plate may have a complicated shape when optimized in this manner.

Depending on the construction of the ion source, it may be beneficial to shape the cooled plate to block radiation from other parts, as well as denser portions of the discharge plasma. Although water is a convenient cooling fluid, other liquids are practical. Because of the rapid drop in radiated energy with energy (radiated energy varies as $T^4$), sufficient cooling may also be obtained with conduction through solid parts. Note that conduction across bolted joints is generally poor in a vacuum. Conduction should therefore be through continuous pieces, rather than through several parts bolted together.

A variety of alternative embodiments are possible. The magnetic-field shape used in the preferred embodiment of this invention is similar to the one used in the original ion source of the type shown in U.S. Pat. No. 3,156,090 (Kaufman), incorporated herein by reference. A variety of other magnetic-field shapes can also be used. Two-grid ion optics can be used (as illustrated herein) as well as either single-grid or three-grid ion optics.

In addition to using various ion optics, it is possible to remove the ion optics and allow the plasma to escape directly. In this case the ions are neutralized by electrons escaping from the discharge volume and a separate neutralizer is not required. Such a configuration is usually called a plasma source; consequently, an ion source is simply a plasma source with the addition of ion optics and neutralizer.

The substrate heating from the neutralizer can also be reduced by substituting an electron-source that emits less heat, using for example a hollow-cathode rather than a hot filament neutralizer.

The embodiment of FIG. 3 was tested in an ion source with a beam diameter of 20 cm. The discharge voltage was 40 V, the beam-supply voltage was 100 V, and the accelerator supply voltage was 350 V. The substrate was located 35 cm from the ion source. When installed, the water-cooled plate had a diameter of 10 cm and was located 2.5 cm from the screen grid.

Figure 5:
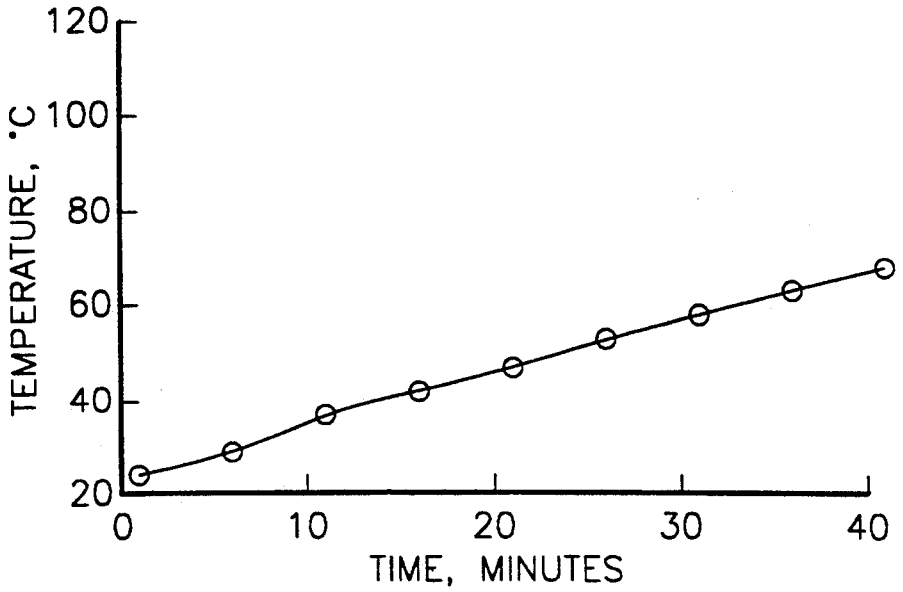
FIG. 5 is a graph which shows the variation of substrate temperature with operating time when using an ion source constructed according to the present invention.

The substrate temperature variation obtained using an ion source without the water-cooled plate is shown in FIG. 2. The temperature variation with the water cooled plate installed is shown in FIG. 5. After an hour of ion source operation with an operating neutralizer, the use of the water cooled plate reduced the substrate temperature from 108° C. to 82° C., a reduction of 26°. This temperature reduction is important because many plastics, whether used for a photoresist in patterned etching or as the substrate material, must be kept below about 100° C.

While a particular embodiment of the invention has been shown and described, and certain alternatives have been mentioned, it will be obvious to those skilled in the art that changes and modifications may be made without departing from the invention in its broader aspects. Therefore, the aim in the appended claims is to cover all such changes and modifications as fall within the true spirit and scope of that which is patentable.

What is claimed is:

1. In a plasma source including a chamber having an open end and within which thermal radiation is developed, wherein ions are produced by means of electrical discharge and then propelled outwardly toward a target substrate, and wherein the improvement comprises a cooled plate positioned in said chamber to reduce escape of said thermal radiation from said chamber.

2. The improvement in accordance with claim 1, wherein said plate has a cross-sectional area which is about 10 to 50% of the cross-sectional area of said chamber.

3. The improvement in accordance with claim 1, wherein said plate is cooled by means of a fluid line extending around, and in heat conductive contact with, said plate.

4. The improvement in accordance with claim 3, wherein water is passed through said fluid line to cool said plate.

5. The improvement in accordance with claim 1, wherein said plasma source comprises a hot electrode.

6. The improvement in accordance with claim 5, wherein said hot electrode comprises an electron-emitting cathode.

7. The improvement in accordance with claim 1, further comprising grid means positioned at said open end of said chamber, wherein said ions exit said chamber through said grid means.

8. The improvement in accordance with claim 7, further comprising electron emitting neutralizer means adjacent said grid means forwardly of said open end of said chamber.

9. A method for reducing escape of thermal radiation from a plasma source of the type including a chamber having an open end, wherein ions are produced and then propelled outwardly toward a target substrate, wherein the method comprises the step of positioning a cooled plate in such chamber in a manner such that escape of thermal radiation from said open end of said chamber is reduced.

10. A method in accordance with claim 9, wherein said plate has a cross-sectional area which is about 10 to 50% of the cross-sectional area of said chamber.

11. A method in accordance with claim 9, wherein said plate is cooled by means of a fluid line extending around, and in heat conductive contact with, said plate.

12. The improvement in accordance with claim 11, wherein water is passed through said fluid line to cool said plate.

13. A method in accordance with claim 9, wherein said plasma source comprises a hot electrode.

14. A method in accordance with claim 13, wherein said hot electrode comprises an electron-emitting cathode.

15. A method in accordance with claim 9, further comprising grid means positioned at said open end of said chamber, wherein said ions exit said chamber through said grid means.

16. A method in accordance with claim 15, further comprising electron emitting neutralizer means adjacent said grid means forwardly of said open end of said chamber.

* * * * *